United States Patent [19]

Schaeren et al.

[11] 4,322,834

[45] Mar. 30, 1982

[54] WATCH CASE WITH INTERENGAGING FLANGED GLASS AND FLANGED CASING RING

[75] Inventors: Walter Schaeren, Bienne; Claude Ray, La Chaux-de-Fonds, both of Switzerland

[73] Assignee: General Watch Co. Ltd., Bienne, Switzerland

[21] Appl. No.: 58,157

[22] Filed: Jul. 17, 1979

[30] Foreign Application Priority Data

Jul. 17, 1978 [CH] Switzerland ..... 7702/78

[51] Int. Cl.[3] ..... G04B 37/00

[52] U.S. Cl. ..... 368/296

[58] Field of Search ..... 58/53, 88 R, 88 C, 88 G, 58/90 R, 91 R; 368/294–296, 309

[56] References Cited

U.S. PATENT DOCUMENTS

| | | | |
|---|---|---|---|
| 2,586,086 | 2/1952 | Pretre | 58/88 G |
| 2,709,333 | 5/1955 | Fengler | 58/91 |
| 2,792,684 | 5/1957 | Dinstman | 58/91 |
| 3,386,239 | 6/1968 | Shiffman | 58/91 |
| 3,688,492 | 9/1972 | Yabana | 58/91 |
| 3,828,549 | 8/1974 | Nozama et al. | 58/90 R |
| 4,083,178 | 4/1978 | Sekiguchi et al. | 58/88 R |

FOREIGN PATENT DOCUMENTS

| | | | |
|---|---|---|---|
| 49-38461 | 10/1974 | Japan . | |
| 331601 | 7/1958 | Switzerland | 58/90 R |
| 347780 | 8/1960 | Switzerland . | |
| 447046 | 3/1968 | Switzerland | 58/91 |

*Primary Examiner*—Vit W. Miska

*Attorney, Agent, or Firm*—Sherman & Shalloway

[57] ABSTRACT

A watch case and means for fastening a viewing crystal to the upper opening of the watch case. The upper opening is provided with projections and the viewing crystal is provided with a flange for engaging the underside of the projections, on at least a part of its thickness. The viewing crystal is introduced freely into the upper opening and rests on a flexible element. Fastening is accomplished by pushing the piece of glass to compress the flexible element and engaging the flanges under the projections by rotation or movement in the case of the viewing crystal. The invention is particularly advantageous for monopiece cases.

14 Claims, 9 Drawing Figures

WATCH CASE WITH INTERENGAGING FLANGED GLASS AND FLANGED CASING RING

BACKGROUND OF THE INVENTION

1. Field of the Invention

The present invention relates to a watch case with a flanged upper opening for fastening a flanged piece of glass and including at least one flexible sealing element. The invention offers an elegant and simple means of fastening the viewing crystal to the watch case securely.

2. Description of the Prior Art

Various systems are known which make it possible to fasten the viewing crystal to the upper opening of a watch case. For example, the viewing crystal can be cemented to a rim or held by friction with a joint or gasket of the rim. Cases are also known where they are held under a ring of the case portion or of the rim.

Where monopiece cases are concerned, it must be possible to remove and replace the viewing crystal each time one wants to have access to the movement. It is known that the viewing crystal may be fitted to the upper opening of the case tightly, or held by friction. There are also systems which make it possible to fasten the viewing crystal by means of a rim so that it is easily moved. Swiss Pat. No. 347,780, for example, proposes a means in which the viewing crystal, having a shape in conformity with its rim, is fastened to the case portion by a rotation movement which engages a projection of the rim in the grooves of the case portion. The first disadvantage of this device is the fact that it is not very secure. Any shock to the outer edge of the rim can bring about the premature disengagement of the viewing crystal. Furthermore, this device does not permit the making of fine rims for elegant watches since their height must exceed the thickness of the edge.

Another device is proposed in the Japanese working model No. 1,087,680. There a round viewing crystal is cemented to the rim, with the latter having notches or slots which engage on the projections of the dial. The greatest disadvantage of this device is the fact that it requires a dial of superior mechanical resistance so as not to yield under the shocks which might release the viewing crystal. Furthermore, the rotating movement is only checked by the friction of the seal with the wall of the rim or the case portion. That effort is easy to overcome, and the viewing crystal can be released prematurely at any moment.

SUMMARY OF THE INVENTION

The specific purpose of the present invention is to remedy the disadvantages referred to and to propose an infallible and elegant means of fastening viewing crystal to the upper openings of watch cases. The means proposed can be applied to circular openings as well as to specially-shaped openings, to monopiece cases or to others.

The object of the invention is characterized in that the upper opening includes an inner groove bounded by a lower shoulder which serves as a lower support for the flexible element, an inner wall which serves as lateral support for the flexible element and an upper flange having projections on its circumference; in which the circumference of the viewing crystal has a means of engaging the underside of the flanges on at least a part of the thickness of the piece of glass so that the viewing crystal can be introduced freely into the upper opening, rest against the flexible element and be engaged to the upper opening by a driving movement followed by the engagement of the means of engaging of the piece of glass on the projections.

The invention comprises a particular watch case with upper opening associated with a viewing crystal fitted to the opening. The invention makes it possible to fasten the piece of glass directly to the watch case without having the need of intermediary agents. Fastening is not accomplished tightly but rather so that it can be easily moved, and the fastening is devised in such a way that no element of the fastening is exposed—thus avoiding any permature disengagement. Thus, the fastening is completely secure.

The invention can be put into practice with a number of variants. For example, consider the embodiment wherein the watch case has an essentially circular upper opening and includes projections on its circumference. The viewing crystal, which may be flat, convex, mineral, plastic, etc., has notches corresponding to the projections. The viewing crystal is introduced into the opening by placing the notches opposite the projections until it rests on the flexible element. By exerting pressure on the piece of glass and compressing the flexible element, the projecting parts of the viewing crystal located between the notches engage the projections of the opening by a rotating movement.

The projecting parts of the viewing crystal can be of a height equal to the thickness of the viewing crystal, in which case the entire viewing crystal engages under the upper edge of the opening, or a lower height. The notches, particularly in the case of mineral, flat viewing crystal, can be made by milling straight lines in the disk of the viewing crystal material.

The invention also includes variants in which the upper opening has any shape whatever. If the upper opening has two parallel sides, the fastening of the viewing crystal onto the projections of the upper opening on those two sides can be accomplished by sliding or transferring the piece of glass onto the projections. Furthermore, for any noncircular shape of the opening, the fastening of the viewing crystal can be accomplished by a rotary movement which permits the engagement of the eccentric parts of the viewing crystal on a projection of the opening. In the latter case, the inner edge of the upper opening does not have interruptions but consists of a continuous projection all along the circumference.

It should be noted that the flexible element, in all the variants also functions as a seal. The element may be a spring for example.

A decorative false rim can be fastened—by pressing, for example—to the outer edge of the upper opening, especially to conceal the projections, notches or apertures of the upper opening, in all the variants of the invention.

BRIEF DESCRIPTION OF THE DRAWINGS

Other advantages and features of the invention will be explained in the course of the following description based on the annexed drawings, which are given as examples.

DETAILED DESCRIPTION OF THE INVENTION

Figure 1:
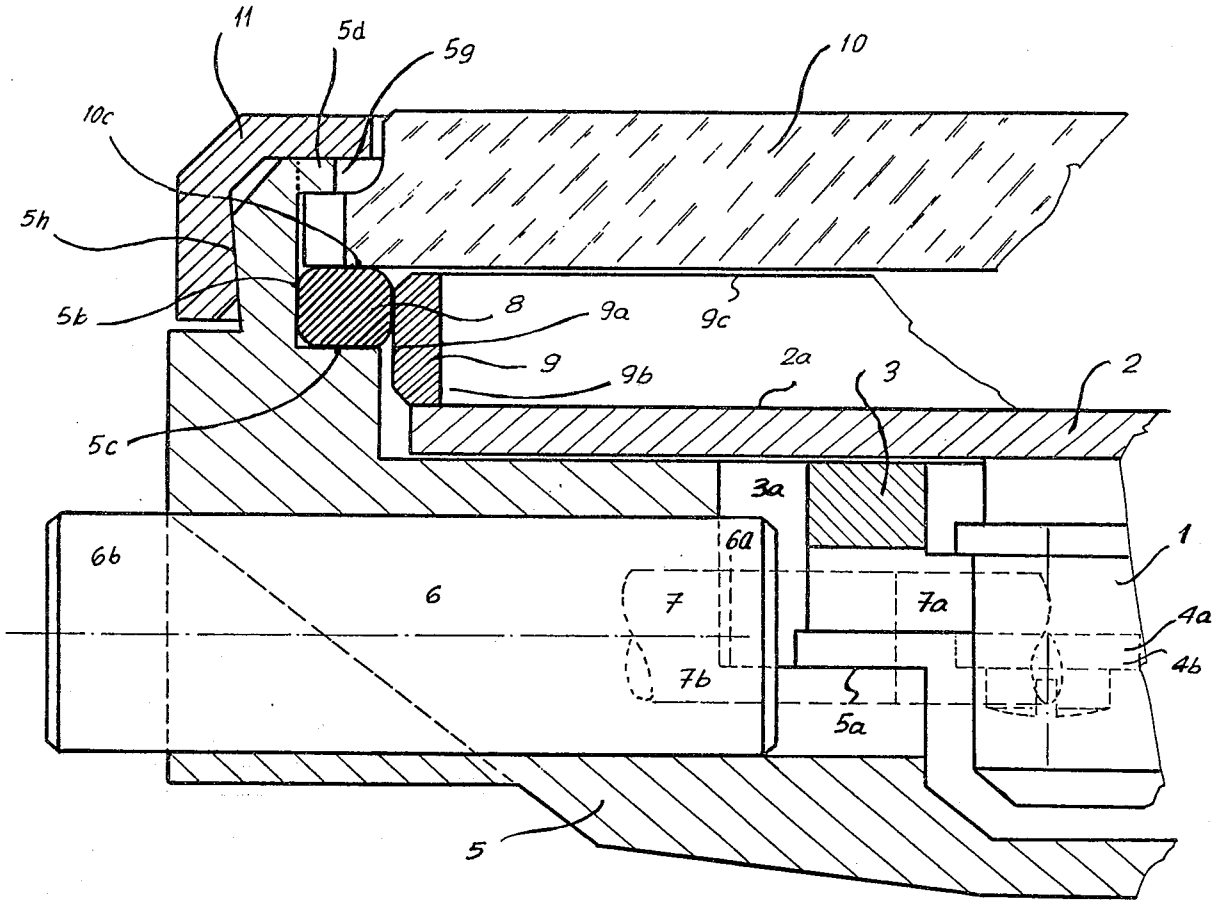
FIG. 1 is a cross section of one embodiment of the watch case of the of the invention.

In FIG. 1, one recognizes the movement 1 to which the dial 2 is rigidly fastened. The movement 1 is held by an encasing ring 3 by means of screws 4*a* and 4*b*. In the illustration in FIG. 1, the movement 1 is located in a monopiece case 5 and rests on a bearing surface 5*a*. The ring 3 ensures the limitation in height of the assembly and centers, by means of a milled passage 3*a*, the assembly with respect to the crown tube 6. The axis of tube 6 corresponds to the axis of the winding stem 7 of the movement. An inner part 6*a* of tube 6 extends into the milling 3*a* of the confining ring 3 and the other part 6*b* ensures the centering of the winding wheel and the setting of the watch. The winding and setting stem 7 is in two pieces. It is of the so-called "broken-stem" type. One part 7*a* forms one piece with the movement while the other part 7*b* forms one piece with the crown. The stem 7 is assembled when the movement is placed into the case.

The upper opening of the watch case 5 in FIG. 1 can be either essentially circular or have a special shape. It includes an inner groove delimited by a lower shoulder 5*c* which serves as a lower support for a flexible element 8, a lower wall 5*b* which serves as a lateral support for the flexible element 8 and an inwardly projecting upper flange 5*d*.

Figure 2:
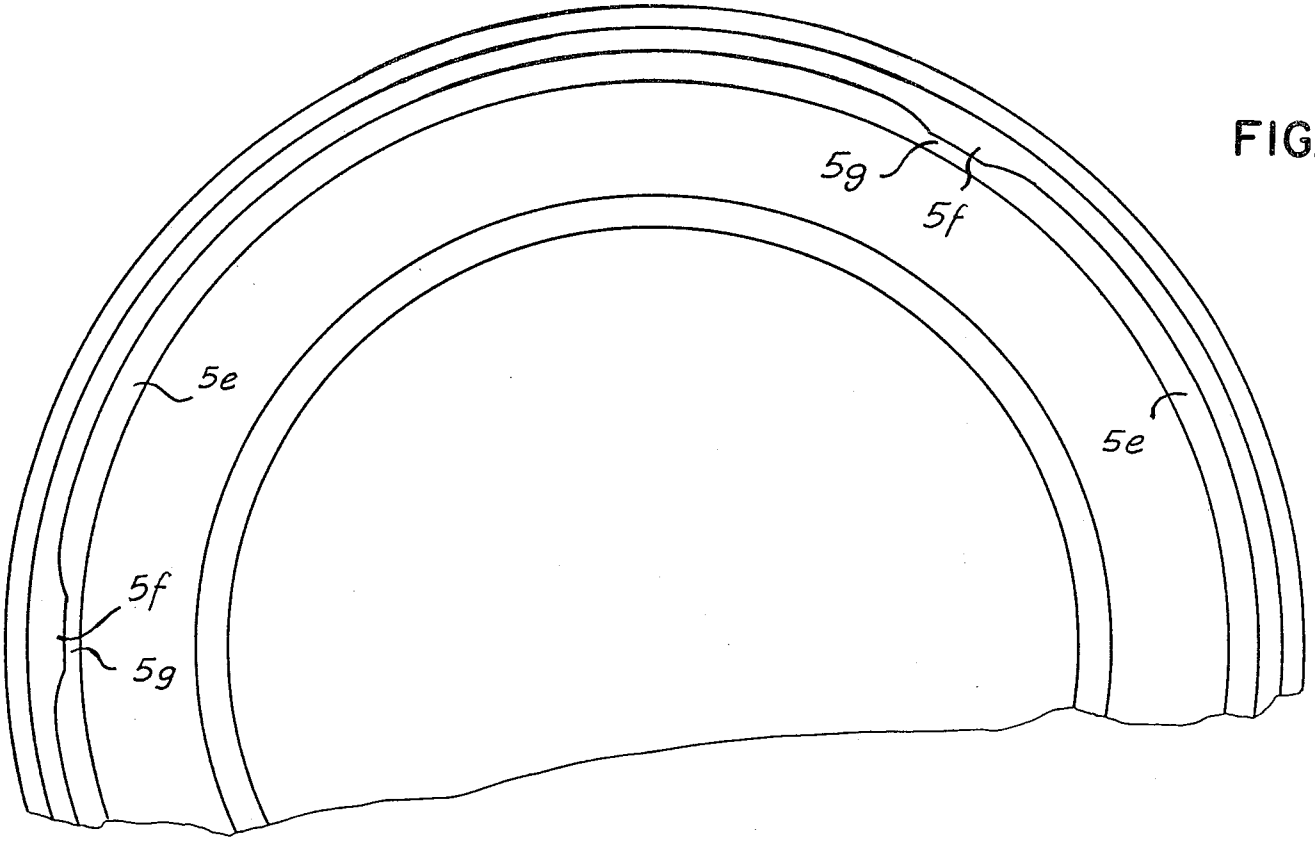
FIG. 2 is a plan view of the upper opening of the watch case.

In the case of an essentially circular opening, as illustrated in FIG. 2, it can be seen that the partial, upper flange 5*d* forms projections 5*f* on its circumference. The edge 5*g* of the upper opening is essentially circular except at the places where the projections 5*f* are located. In the specific embodiment which is illustrated, the interruptions 5*e* are millings which extend the inner wall 5*b* to the outside surface.

Figures 3A, 3B:
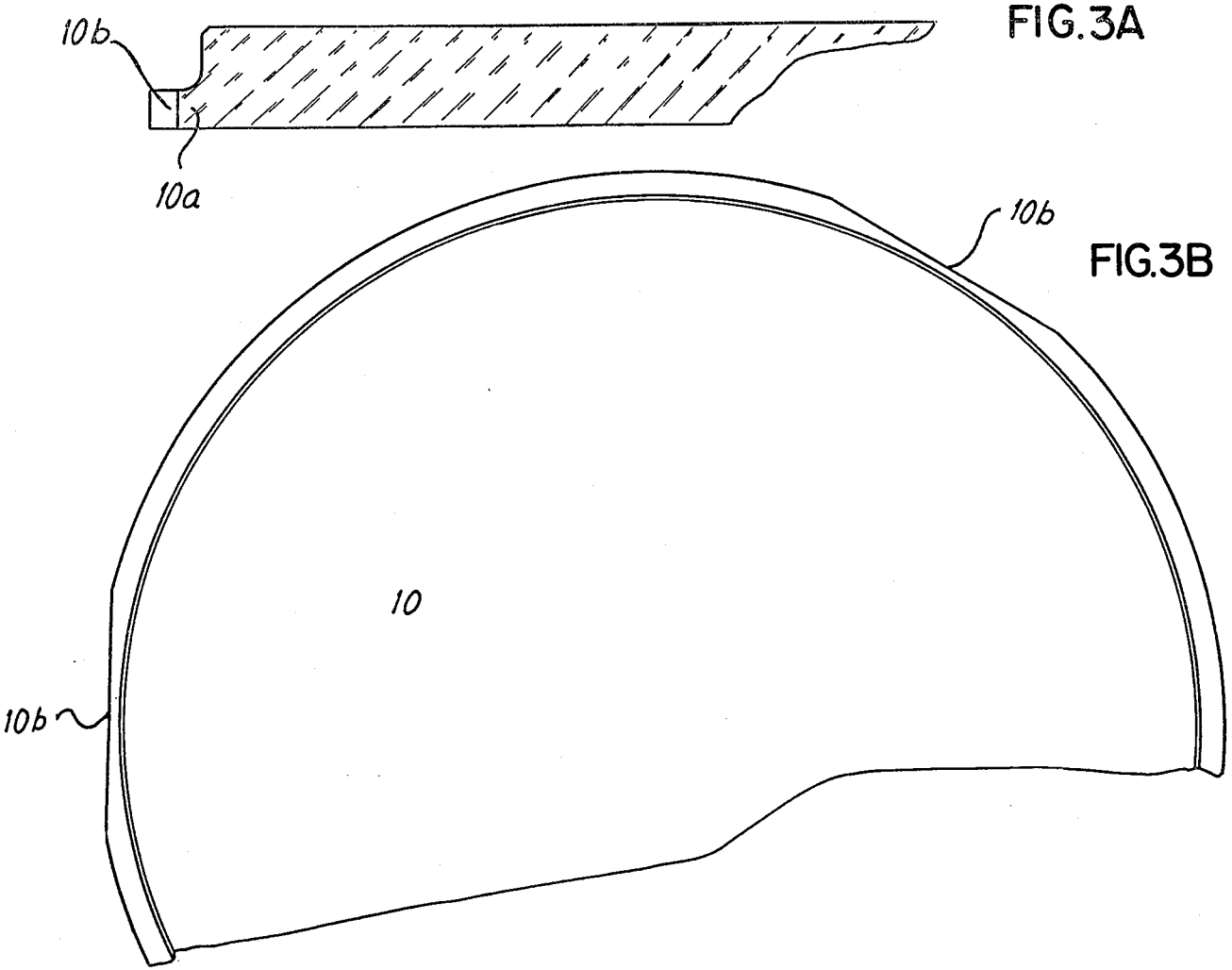
FIG. 3A is a cross-sectional view of a possible way of making the viewing crystal of the watch according to the invention.
FIG. 3B is a plan view of a possible way of making the viewing crystal of the watch according to the invention.

The viewing crystal corresponding to the upper opening of FIG. 2, and illustrated in FIG. 3, is designated by reference character 10. A flat viewing crystal was chosen for illustration. However, the shape may be convex or any other desirable shape. The viewing crystal 10 has a lower flange 10*a* reaching approximately mid-height and extending over the extire circumference of the viewing crystal. The lower flange 10*a* has notches 10*b* which correspond to the projections 5*f* of the upper flange 5*d*. The simplest way to make these notches, especially when using a mineral glass of sapphire, for example, is to make flat, or straight, cuts in the lower flange 10*a*, as is illustrated.

Figure 4:
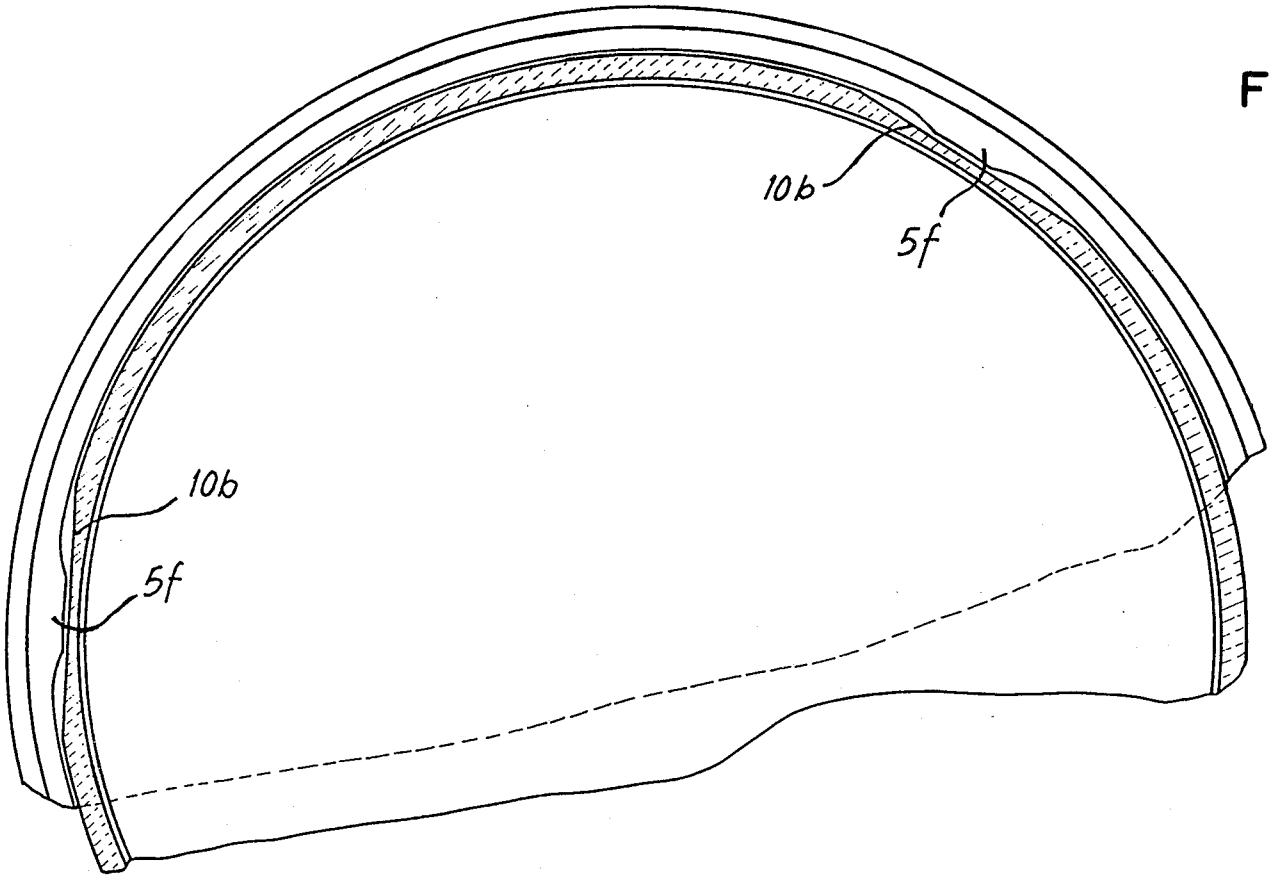
FIGS. 4 and 5 illustrate the means for fastening the viewing crystal to the upper opening of a watch case according to the invention, in the case of an essentially circular viewing crystal.

FIG. 4 shows how to place the viewing crystal 10 on the upper opening of the watch case by locating the notches 10*b* of the viewing crystal opposite the projections 5*f* of the upper flange 5*d* in such a way that the viewing crystal 10 can penetrate freely into the upper opening.

Figure 5:
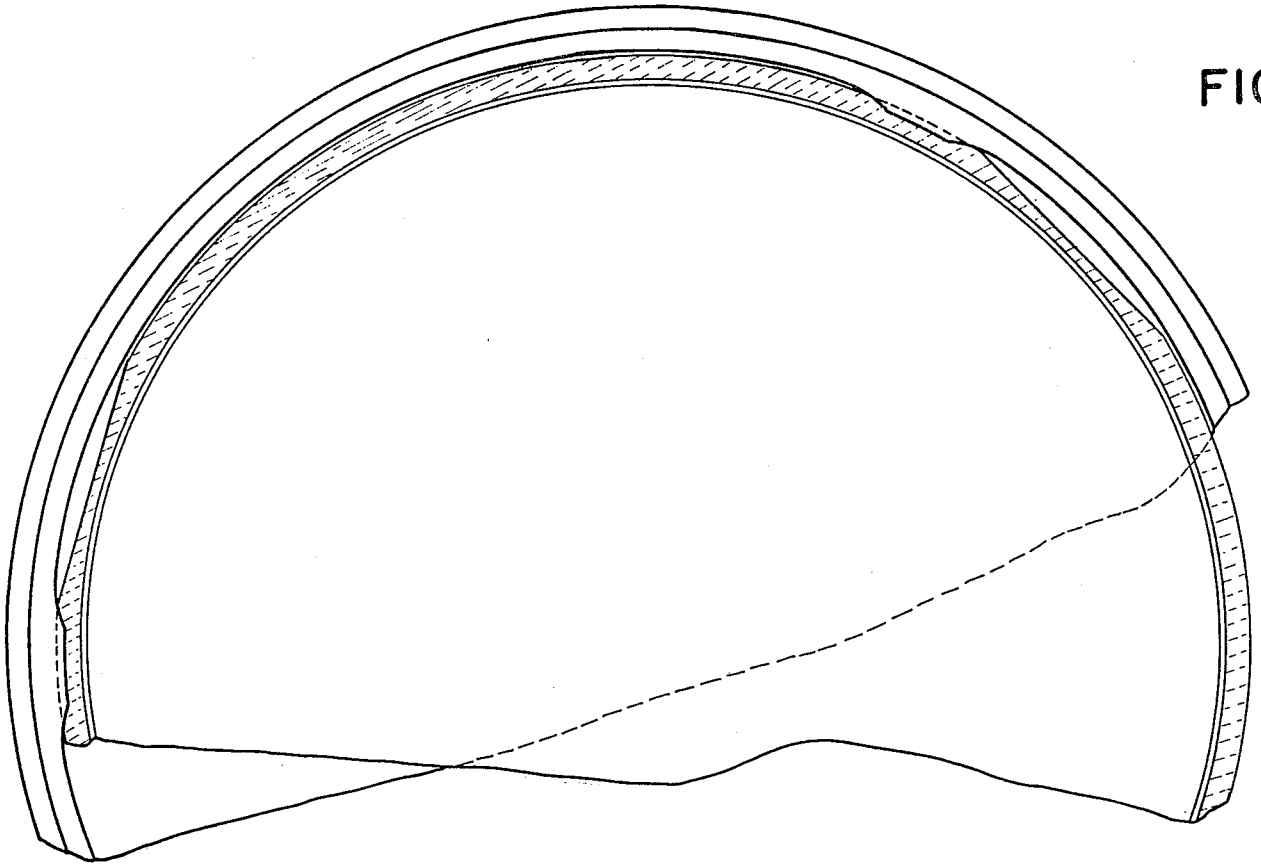

As illustrated in FIG. 4, the viewing crystal 10 is now resting on the flexible element 8. The thickness of the flange 10*a* of the viewing crystal is greater than the gap left between the element 8 and the lower part of the projections 5*f*. By exerting external, downward pressure on the viewing crystal 10, the viewing crystal 10 can be forced into the opening by distorting the flexible element 8 and rotating the viewing crystal 10. This results in the lower flanges 10*a* being located under the projections 5*f* and the viewing crystal 10 is firmly fixed in the upper opening of the watch case, as is illustrated in FIG. 5.

Figure 6A:
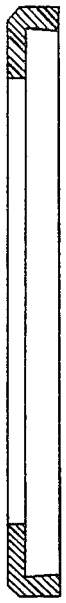
FIG. 6 shows, in plan view, an embodiment of the unit consisting of the viewing crystal and the upper opening in the case of a specially-shaped viewing crystal.
Figure 6B:
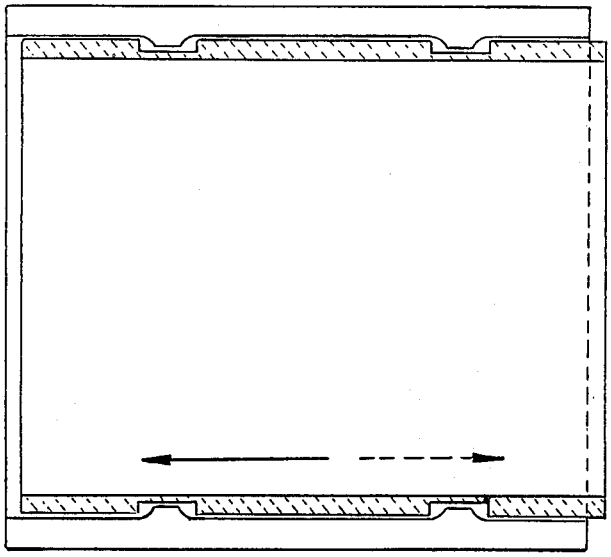

FIGS. 6*a* and 6*b* show an alternative embodiment for fastening the viewing crystal to the upper opening of a rectangular-shaped case in accordance with the invention. Further, in order to maintain the viewing crystal in position, a false rim may be located tightly in position which would surround the upper opening, for example. FIG. 6*a* is a cross section of such a rim which can be connected to an upper opening, as seen from above in FIG. 6*b*. The fastening of the rim prevents any further sliding of the viewing crystal by closing one side or the two sides which have remained free.

FIG. 1 further illustrates an assembly which is particularly adapted to round, monopiece cases or those having special shapes. As a matter of fact, the case includes an additional collar 9 which is located on the circumference of the dial 2, between the viewing crystal 10 and the dial 2. The inner edge 9*b* of the collar 9 represents the visible opening of the dial. The outer edge 9*a* of the collar 9 completes the seating of the flexible element 8—here an O-ring—and the circumference of the outer edge 9*a* is approximately equal to the internal diameter of the free O-ring 8.

The height of the collar is slightly less than the space between the dial 2 and the lower surface of the piece of glass 10, so that a space 9*c* exists between the upper edge of the collar 9 and the viewing crystal 10. The space 9*c* makes it possible to fasten the viewing crystal 10 to the upper opening of the watch case without jamming and allows compression of the O-ring 8 so that the viewing crystal 10 may be rotated into position.

The element 8, distorted by the viewing crystal 10, exerts pressure on the collar 9 which maintains it in a fixed position. The axial mobility of the collar 9 in case of external shock is limited by the space 9*c*, which is insufficient to overcome the forces of friction of the element 8 on the collar 9 and bring about a sliding of the collar 9 on the element 8. Thus the collar 9 always returns to its place in the lower position and retains the positioning of the movement 1 in the monopiece case.

If one is dealing with a two-piece case with a removable bottom, the positioning of the movement is generally accomplished by other means (fastening after the bottom part). Then one can either retain the collar 9 to close off the seating of the O-ring 8 or provide an elbow or flange on the shoulder 5*c* to close off the seating of the element.

It is evident that one obtains a hermetically sealed case by choosing the material for the flexible element 8 judiciously. If the bottom part is removable, a seal between the bottom and the case portion will be provided.

Figure 7:
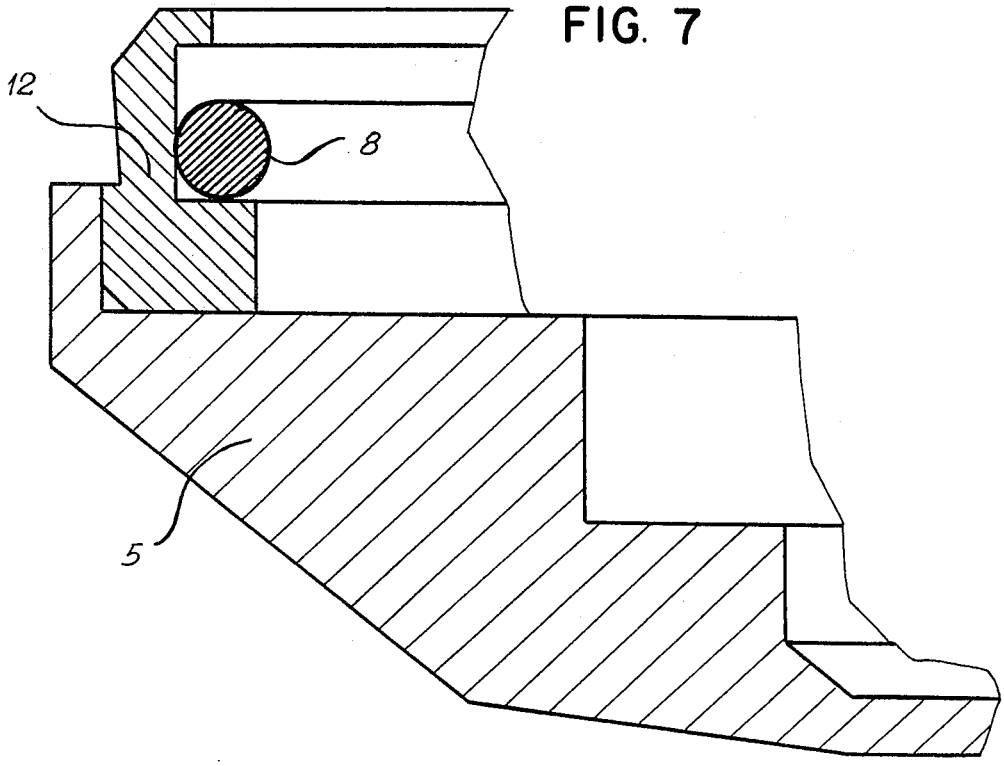
FIG. 7 is an axial section of another embodiment of the watch case in accordance with the invention.

The upper opening, including the inner groove bounded by the lower shoulder 5*c*, the inner wall 5*b* and the upper flange 5*d*, can constitute a self-contained, integral piece as in rim 12 illustrated in FIG. 7. The rim 12 can be press fitted, cemented, soldered, screwed, etc., to the bottom case portion of a two-piece watch case or to the case portion of a three-piece watch case. Thus, rim element 12 can be designed with normalized dimensions so that it will be a modular element adaptable to a great variety of watch cases. A second advantage of the rim 12 is the fact that it makes it easier to produce watch cases, and especially monopiece cases.

All the various embodiments of the invention may be provided with decorative rim covers 11, as is shown in FIG. 1. These rim covers 11 can be combined with counters of expired time or depth meters for watches to be used in diving, set with stones in the case of luxury watches, etc. The rim cover conceals the mechanism for fastening the viewing crystal 10 to the upper opening and can be adjusted tightly onto surface 5*h* of the watch case 5. Surface 5*h* is outwardly directed and the corresponding inner surface of rim 11 is inwardly directed to the same degree forming an interference fit tightly interengaging the watch case 5. The rim cover 11 can advantageously be used to vary the esthetic appearance of the entire assembly without changing internal and functional standardization. In particular, it can be designed as fine as is desired, giving the watch an elegant character.

Thus, the watch case of the invention has numerous advantages. In the first place, this watch case can be used just as well for fine and elegant watches as for sport watches. In the second place, it makes it possible to guarantee a high quality hermetic seal.

In the third place, the method of fastening the piece of glass to the upper opening is absolutely secure. In fact, the viewing crystal cannot be disengaged prematurely by an external shock on one edge of the viewing crystal or the rim for the device of the invention does not present any apparent edges. Furthermore, the force of friction between the piece of glass and the joint which is to be overcome is sufficiently large so that the viewing crystal does not free itself. In the fourth place, the watch case of the invention makes a simple and rapid changing of the viewing crystal possible. This is shown to be particularly useful in the case of multifunctional digital watches, where the viewing crystal includes transparent electrodes for the admission of data by capacitive contact on the piece of glass. Defective pieces of glass are replaced rapidly. In this embodiment, as in the others, an internal stop could determine with precision the position of the anchored viewing crystal. Finally, the system for fastening the viewing crystal is applied advantageously to monopiece cases. There is no danger any longer of the movement becoming disengaged prematurely in view of the fact that it is fastened so that it is easily moved (flange-projection) and not by friction, as usually happens with such cases.

Figure 8:
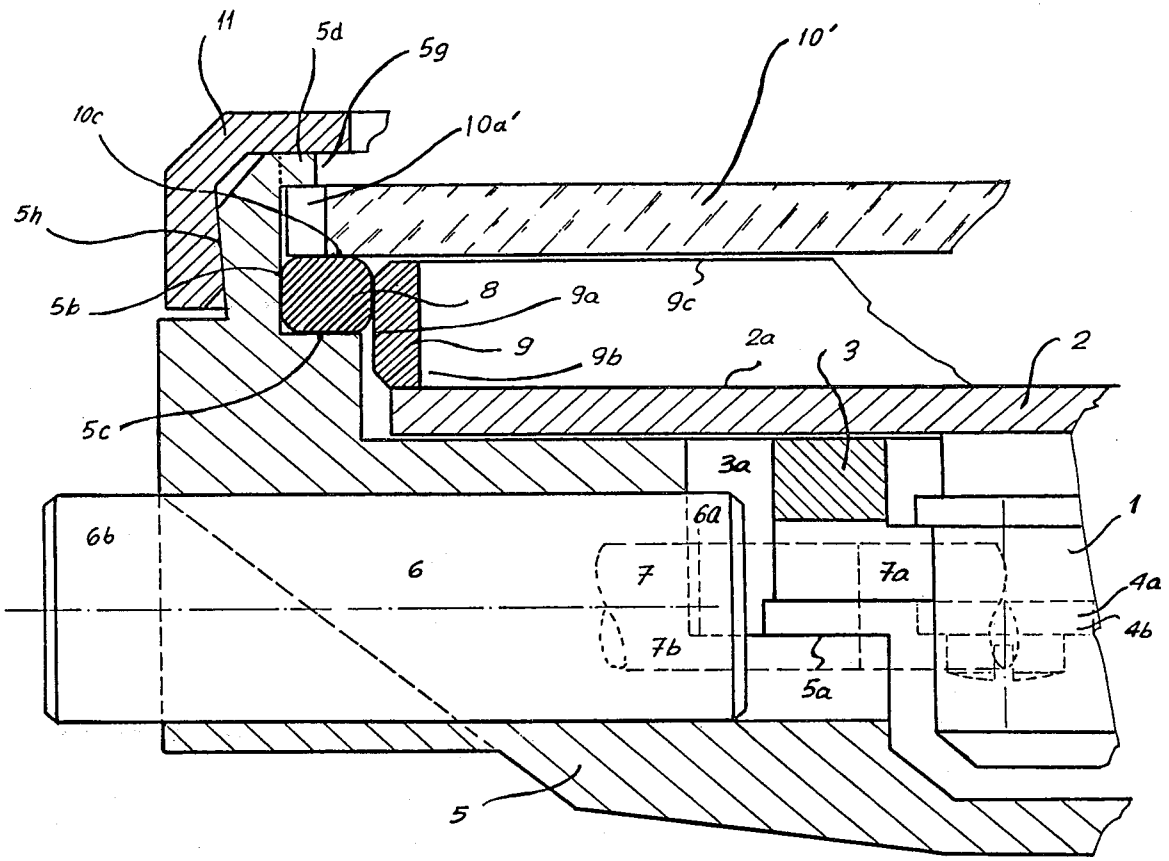
FIG. 8 is a cross-section of an alternate embodiment of the invention, using a viewing crystal having a flange height equal to the thickness of the body of the crystal.

It is possible to make the viewing crystal of a single thickness, as shown in FIG. 8. In that embodiment, the flange 10A′ is equal in height to the remainder of the viewing crystal 10′, reducing the amount of milling required for the formation of the crystal.

The possible variants in the embodiment of the watch case of the invention are not limited to those which are illustrated. For example, the viewing crystal, itself, can be convex or flat. In the latter case, the flange 10*a* could have a height less than, equal to or greater than the thickness of the viewing crystal, depending upon the appearance which it is desired to give to the watch. Furthermore, the idea of projections on the upper opening of the watch case and of notches on the viewing crystal is not a limiting one. It is contemplated that the viewing crystal may be provided with catches or stops and that the upper opening may have notches or projections in the upper flange. In the noncircular embodiment, eccentric parts of the viewing crystal may engage a continuous projection.

What is claimed is:

1. A watch case (5) with an upper opening for fastening a rigid viewing crystal (10) and provided with at least one flexible element (8), a dial (2) rigidly fixed to a movement (1), the dial (2) being supported by a confining ring (3) resting on a bearing surface (5*a*) on the inside of the case characterized in that:

(a) the upper opening includes an inner groove bounded by a lower shoulder (5*c*) which serves as a lower support for the flexible element (8), an inner wall (5*b*) which serves as a lateral support for the flexible element (8) and an upper flange (5*d*) located above the flexible element (8) forming projections (5*f*) on its inner circumference;

(b) the circumference of the viewing crystal (10) has means of engaging the projections so that the viewing crystal (10) can be introduced freely into the upper opening, rest against the flexible element (8) and engage the upper opening by a driving movement causing the engagement of the means of engaging of the viewing crystal (10) on the projections (5*f*) without significantly deforming the viewing crystal (10);

(c) a collar (9), having an outer edge (9*a*), rests on the circumference of the dial (2); and in that (d) the outer edge (9*a*) is in contact with the flexible element (8), so that the collar (9) is subjected to lateral pressure by the flexible element (8), the flexible element (8) fixing the position of the collar (9) and, consequently, the position of the movement (1) by resting the collar (9) on the dial (1).

2. Watch case as claimed in claim 1, characterized in that the means of engaging comprises a lower flange (10*a*) extending along a periphery of the viewing crystal (10) and having notches (10*b*) corresponding to the projections of the upper flange (5*d*), in such a way that the viewing crystal (10) can be introduced freely into the upper opening of the watch case when the notches (10*b*) are opposite the projections (5*f*) and that, subsequently, the viewing crystal (10) can be interconnected to the upper opening by engaging the lower flange (10*a*) under the projections (5*f*).

3. The watch case as claimed in claim 2, characterized in that the upper opening is essentially circular and in that the viewing crystal (10) is essentially circular.

4. The watch case as claimed in claim 2, characterized in that the upper opening has two essentially parallal sides, each of which includes at least one projection.

5. The watch case as claimed in claim 1, characterized in that the projections (5*f*) each have an inner edge (5*g*) in a continuous, noncircular line; in that the means of engaging of the piece of glass consist of flanges on the circumference of the viewing crystal (10), with the outer circumference of the viewing crystal (10) being slightly below the inner edge (5*g*) of the upper opening, so that the viewing crystal (10) can be introduced freely into the upper opening of the watch case and the viewing crystal (10) can subsequently be anchored to the upper opening by engaging the flanges with the projections (5*f*).

6. The watch case as claimed in claim 1 characterized in that the viewing crystal is made of flat, mineral glass and in that the means of engaging consists of a flange having a height less than the thickness of the viewing crystal.

7. The watch case as claimed in claim 1 characterized in that the viewing crystal (10) is made of flat mineral and in that the means of engaging consists of a flange (10*a*) having height equal to the thickness of the viewing crystal (10), so that it forms an integral part of the viewing crystal (10).

8. The watch case as claimed in claim 1 characterized in that the flexible element (8) is an O-ring.

9. The watch case as claimed in claim 1 characterized in that the inner groove bounded by the shoulder (5*c*), the inner wall (5*b*) and the upper flange (5*d*) of the upper opening are integral parts of a rim (12) forming a unitary structure with the watch case.

10. The watch case as claimed in claim 1 characterized in that the upper opening is protected by a decorative rim cover (11).

11. The watch case as claimed in claims 1 or 9 characterized in that the case is a monopiece body.

12. A watch case (5) with an upper opening for fastening a rigid viewing crystal (10) and provided with at least one flexible element (8), characterized in that:

(a) the upper opening includes an inner groove bounded by a lower shoulder (5*c*) which serves as a lower support for the flexible element (8), an inner wall (5*b*) which serves as a lateral support for the flexible element (8) and an upper flange (5*d*) located above the flexible element (8) forming projections (5*f*) on its inner circumference;

(b) the circumference of the viewing crystal (10) has means of engaging the projections so that the viewing crystal (10) can be introduced freely into the upper opening, rest against the flexible element (8) and engage the upper opening by a driving movement causing the engagement of the means of engaging of the viewing crystal (10) on the projections (5*f*) without significantly deforming the viewing crystal (10); and in that (c) viewing crystal is made of mineral glass having flat upper and lower surface, and in that the means of engaging consists of a flange having a height less than the thickness of the viewing crystal, said flange not extending beyond the planes of the upper and lower surfaces, and a lower surface of the flange being substantially coplanar with the lower surface.

13. The watch case as claimed in claim 3 or 12 characterized in that the notches (10*b*) of the viewing crystal (10) consist of straight cuts along straight lines tangential to the periphery of the viewing crystal (10).

14. A watch case (5) with an upper opening for fastening a rigid viewing crystal (10) and provided with at least one flexible element (8), characterized in that:

(a) the upper opening includes an inner groove bounded by a lower shoulder (5*c*) which serves as a lower support for the flexible element (8), an inner wall (5*b*) which serves as a lateral support for the flexible element (8) and an upper flange (5*d*) located above the flexible element (8) forming projections (5*f*) on its inner circumference;

(b) the circumference of the viewing crystal (10) has means of engaging the projections so that the viewing crystal (10) can be introduced freely into the upper opening, rest against the flexible element (8) and engage the upper opening by a driving movement causing the engagement of the means of engaging of the viewing crystal (10) on the projections (5*f*) without significantly deforming the viewing crystal (10); and in that (c) the viewing crystal (10) is made of flat mineral and in that the means of engaging consists of a flange (10*a*) having height equal to the thickness of the viewing crystal (10), so that it forms an integral part of the viewing crystal (10).

* * * * *